US009873976B2

(12) United States Patent
Al Jaj Eid

(10) Patent No.: US 9,873,976 B2
(45) Date of Patent: Jan. 23, 2018

(54) HAND WRAPS DECREASER, ROLLER, AND WASHING BAG

(75) Inventor: Yazid Al Jaj Eid, London (GB)

(73) Assignee: Yazid Al Haj Eid, London (GB)

( * ) Notice: Subject to any disclaimer, the term of this patent is extended or adjusted under 35 U.S.C. 154(b) by 324 days.

(21) Appl. No.: 14/009,345

(22) PCT Filed: Apr. 16, 2012

(86) PCT No.: PCT/GB2012/000351

§ 371 (c)(1),
(2), (4) Date: Oct. 2, 2013

(87) PCT Pub. No.: WO2012/140403

PCT Pub. Date: Oct. 18, 2012

(65) Prior Publication Data

US 2014/0177982 A1 Jun. 26, 2014

(30) Foreign Application Priority Data

Apr. 15, 2011 (GB) ..... 1106448.2

(51) Int. Cl.
*D06F 95/00* (2006.01)
*B65B 67/04* (2006.01)

(52) U.S. Cl.
CPC ..... *D06F 95/00* (2013.01); *D06F 95/006* (2013.01); *B65B 67/04* (2013.01)

(58) Field of Classification Search
CPC ..... B65D 33/16; B65D 30/04; B65D 33/00; B65D 33/24; B65H 18/026; B65H 18/00; B65B 67/04; D06F 95/00; D06F 95/006
See application file for complete search history.

(56) References Cited

U.S. PATENT DOCUMENTS 1,416,160 A * 5/1922 Barrier ..... B65B 67/04 53/258
2,712,229 A * 7/1955 Jones ..... D06F 47/06 68/21
4,817,762 A * 4/1989 Powell ..... B65B 67/085 188/67
7,014,381 B1 * 3/2006 Graham ..... A47K 7/03 401/201
8,919,708 B1 * 12/2014 Graves ..... B65F 1/1415 141/390
2002/0075470 A1 * 6/2002 Ishizuka ..... G03B 27/588 355/72
2004/0202520 A1 * 10/2004 Guenther ..... B60P 7/0846 410/103
2007/0014493 A1 * 1/2007 Boyd ..... D06F 95/006 383/117
2009/0302079 A1 * 12/2009 Lorenz ..... A45C 7/0077 224/577
2013/0206895 A1 * 8/2013 Van Benthem ..... B60P 7/0846 242/532.6
2014/0270591 A1 * 9/2014 Joly ..... A45C 3/00 383/102
2015/0013091 A1 * 1/2015 Dibelardino ..... A47K 7/03 15/209.1
2015/0295208 A1 * 10/2015 Schumann ..... H01M 2/02 429/50

* cited by examiner

*Primary Examiner* — Christopher Harmon

(57) ABSTRACT

This device is used to decrease, roll, and wash hand wraps that boxers and martial artists use, the domes and their covers decrease the wraps, the axle rolls them inside the bag, and the mesh structure allows a thorough washing of the hand wraps inside the bag by placing it in a washing machine.

1 Claim, 1 Drawing Sheet

HAND WRAPS DECREASER, ROLLER, AND WASHING BAG

Figure 1:
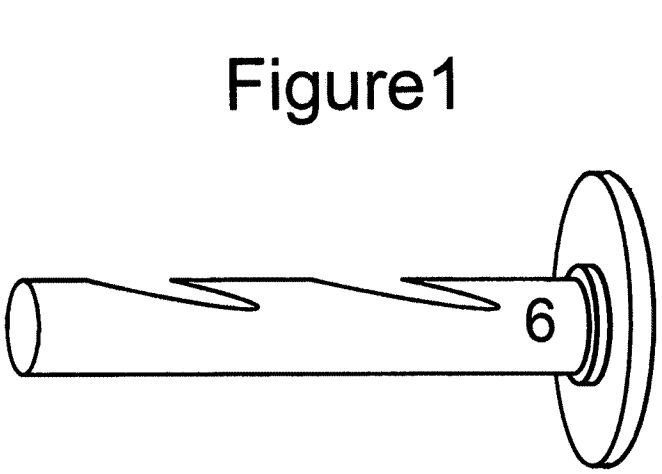

It is a cylinder shaped bag made of an outer shell of polyester mesh which opens onto a body made of Plastic, this body consists of three disks attached to a half cylinder body to form two chambers equal in size, and each one of the discs has a hole in the center.

It consists of the following arts:

1—Half cylindrical hard plastic body defining a cavity divided into two chambers by central disc portion and a disc portion at each end.

2—Mesh fabric cover.

3—Two equal sized domes attached to the cylindrical hard plastic body.

4—A hard plastic cover attached to the mesh containing two equal sized dome cover portions which correspond to said dome portions.

5—A fastening mechanism for securing the fabric cover to the half cylindrical body.

6—Removable axle comprises two slots wherein hand wraps are attached.

7—Central holes for receiving an axle on all three disks of plastic body.

There are two oval shaped domes attached to the Plastic body which appear when the mesh bag is open, there is also a plastic object with two oval covers attached to the edge of the mesh cover, so that when the bag is closed the two cover perfectly overlap the domes.

The cover is then secured in place by hook and loop fastening.

A plastic axle is inserted into the bag from the side, through the holes, and goes from one end to the other, and it is attached to a disc with a handle so that it can be turned, and the hand wraps are attached to it by an opening in the middle.

Each unrolled hand wrap is inserted from its end into one of the chambers inside the bag, and attached to the opening on the inserted axle, the mesh cover is then closed trapping the hand wraps flat between the plastic domes and covers, and when the axle is turned the hand wraps are rolled around it after being decreased through the domes.

Function:

This device is designed to work on hand wraps used by boxers and martial arts practitioners, these wraps are made usually from cotton and polyester, can be elastic, semi-elastic, or non-elastic. 4 to 5 cm wide, and 1 to 5 meters long each, and normally end up with hook and loop to secure it on the hand once it is wrapped.

The invention has three functions:

Rolling Both Wraps at the Same Time:

The axle is inserted through the holes and the hand wraps are attached to it by inserting its end in the opening on the axle, so that each wrap goes inside one of the chambers. Then the mesh cover is closed trapping the wraps between the domes and their covers, and when the handle of the outer plastic disc is rotated anti-clock wise, the axle pulls the wraps inside the bag and they get folded around it.

Decreasing:

When the wraps go through the domes and the covers, any creases and wrinkles are smoothed and they get folded neatly inside the bag without the need of manual flattening or smoothing.

Washing:

After the wraps are completely folded inside the bag, the axle is pulled out and the bag can be washed and dried with the wraps inside it to prevent them from being mingled if washed loosely.

How is this Device Different than Others?

First of all, after 25 year experience in martial arts I can safely say there are no other devices or kits that do what this one does, and even if there any found, none can do the following:

Rolling and Decreasing:

The main function of this device other than rolling the wraps is to decrease them; it is easy to make a pulley-like kit to ROLL the wraps, but the user still faces the problem of creased and mingled wraps, especially after washing, and will have to manually flatten them inch by inch as he/she rolls them.

This device however, solves this problem using the dome and cover to completely decrease and flatten the wraps as they are being rolled without using hands to do so.

Rolling BOTH Wraps at the Same Time:

This is the only device that does that.

Washing and Drying:

This fantastic function solves one of the biggest problems athletes face when using hand wraps, even if the user gets really good at MANUALLY rolling them, they still need to be washed, and when they are takes out of the washing machine they look like something out of a horror movie, extremely mingled and creased and take ages to undo, let alone roll.

This device allows the user to wash and dry the warps inside the bag to keep them nicely rolled and smooth, and when the thick axle is pulled out of the bag, a small gap is left in the center of the rolled wraps, this will allow a better wash throughout the entire length of the fabric.

Drawing 1: Is a perspective of the steps by which the invention is operated,

FIG. 1: Is the Axle

Figure 2:
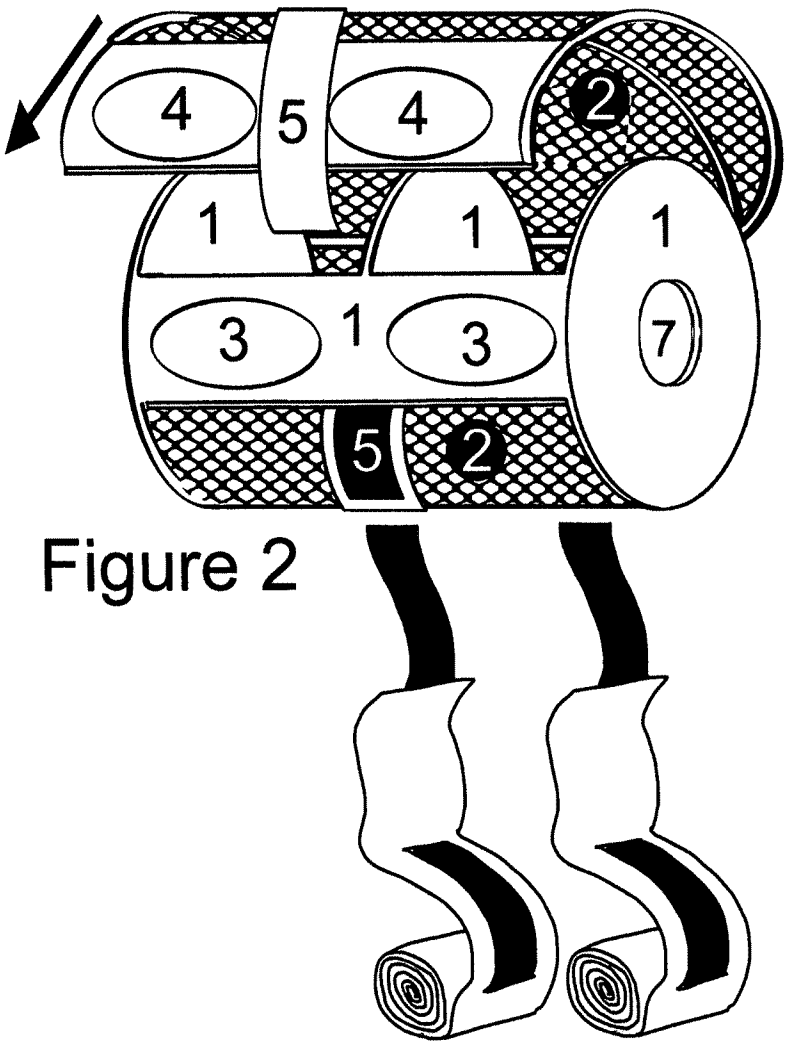

FIG. 2: Is the mesh bag with the inner plastic body, domes and cover, and mesh cover with hook and loop fastening straps.

Figure 3:
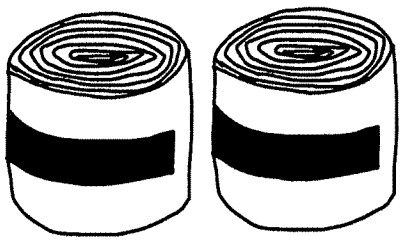

FIG. 3: Is the hand wraps before and after being rolled in the bag.

STEP 1: The handle is inserted into the bag from the side and the tips of the hand wraps are inserted to its opening, STEP 2: The mesh cover is closed and secured with hook and loop then the handle is rolled to spin the axle inside and roll the wraps, STEP 3: The axle is pulled out keeping the wraps nicely rolled inside the bag ready for washing or storage until next use.

Drawing 2: Is a perspective of the structure of the inner plastic part of the bag with the domes attached to it.

The invention claimed is:

1. A cylindrical body for rolling, decreasing and washing hand wraps comprising:

- a half cylindrical hard plastic body defining a cavity divided into two chambers by a central disc portion and a disc portion at each end;
- wherein each disc portion comprises a central hole for receiving an axle;
- said half cylindrical body further including two identical oval dome portions near a top edge of the half cylindrical body;
- a fabric cover positioned over said chambers including two oval dome cover portions which correspond to said dome portions of the half cylindrical body;
- a fastening mechanism for securing the fabric cover to the half cylindrical body;

a removable axle attached to a small handle positioned through the holes of the disc portions and extending through the two chambers;

wherein said removable axle comprises slots configured to allow the hand wraps to be wound inside the cylindrical body by rotation of the handle;

said axle is capable of being removed from said half cylindrical body prior to washing.

* * * * *